US006939064B2

(12) United States Patent
Kawaguchi et al.

(10) Patent No.: US 6,939,064 B2
(45) Date of Patent: Sep. 6, 2005

(54) PRINTING APPARATUS AND METHOD

(75) Inventors: Koichiro Kawaguchi, Kanagawa (JP); Yuji Nakano, Kanagawa (JP); Haruyuki Yanagi, Tokyo (JP); Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/058,411

(22) Filed: Jan. 30, 2002

(65) Prior Publication Data

US 2002/0114655 A1 Aug. 22, 2002

(30) Foreign Application Priority Data

Jan. 31, 2001 (JP) ..... 2001/024553

(51) Int. Cl.[7] ..... B41J 13/02; B65H 5/06; B65H 7/14

(52) U.S. Cl. ..... 400/283; 400/624; 400/625

(58) Field of Search ..... 400/624, 283, 400/625, 636, 637, 639; 347/37, 104

(56) References Cited

U.S. PATENT DOCUMENTS

| | | | | | |
|---|---|---|---|---|---|
| 4,844,638 | A | * | 7/1989 | Kagami et al. | 400/636 |
| 5,087,141 | A | * | 2/1992 | Kelly | 400/352 |
| 5,464,291 | A | * | 11/1995 | Kimura et al. | 400/185 |
| 5,620,174 | A | | 4/1997 | Taniguro et al. | 271/10.12 |
| 5,672,019 | A | | 9/1997 | Hiramatsu et al. | 400/624 |
| 5,683,188 | A | * | 11/1997 | Miyazaki et al. | 400/279 |
| 5,867,196 | A | * | 2/1999 | Kiyohara et al. | 347/104 |
| 5,997,129 | A | * | 12/1999 | Matsuhashi | 347/35 |
| 6,092,893 | A | | 7/2000 | Yokoi et al. | 347/104 |
| 6,168,270 | B1 | | 1/2001 | Saikawa et al. | 347/104 |
| 6,168,333 | B1 | * | 1/2001 | Merz et al. | 400/634 |
| 6,435,641 | B1 | * | 8/2002 | Tung et al. | 347/16 |
| 6,457,888 | B1 | * | 10/2002 | Matsumoto | 400/625 |
| 2001/0040616 | A1 | * | 11/2001 | Uchida | 347/104 |

FOREIGN PATENT DOCUMENTS

| | | | | | |
|---|---|---|---|---|---|
| JP | 55067467 | A | * | 5/1980 | B41J/3/04 |

* cited by examiner

*Primary Examiner*—Daniel J. Colilla
(74) *Attorney, Agent, or Firm*—Fitzpatrick, Cella, Harper & Scinto

(57) ABSTRACT

It is an object of the present invention to use a simple configuration to reduce the deviate of an image printed position caused by the behavior of a print sheet when the back end of the sheet slips out from an upstream roller pair. Thus, the present invention provides a printing apparatus including transporting section for transporting a print medium relative to printing heads for printing an image on a print sheet, the apparatus comprising vibrating section for vibrating the transporting section. This vibrating section vibrates the transporting section before the printing heads start a printing operation. Thus, even if the transporting section is stopped at an unstable position when a transporting operation is stopped, the applied vibration brings the transporting section into a stable state sufficiently before a printing operation is started.

14 Claims, 12 Drawing Sheets

NORMAL PRINTING

AFTER-PASS-SWITCH PRINTING

AFTER-NOZZLE-SHIFT PRINTING

PRINTING APPARATUS AND METHOD

This application is based on Patent Application No. 2001-024553 filed Jan. 31, 2001 in Japan, the content of which is incorporated hereinto by reference.

BACKGROUND OF THE INVENTION

1. Field of the Invention

The present invention relates to a printing apparatus and method for a printer, a copy machine, a facsimile terminal equipment, or the like, and specifically, to correction of the deviation of a printed position resulting from an error in transportation of a printing sheet.

2. Description of the Related Art

Conventional printing apparatuses such as printers, copy machines, and facsimile terminal equipment are equipped with a mechanism which transports a printing sheet as a printing medium. The mechanism includes a transportation roller, a pinch roller pressing the printing sheet against the transportation roller and holding the printing sheet between the pinch roller and the transportation roller, a device for causing the pinch roller to apply pressing force on the printing sheet, and other devices. Such transportation mechanism executes transporting operation for the printing sheet fed by a sheet feeding section, in a printing area by a printing head, and two pairs of such transportation mechanisms are generally provided before and behind the printing area, respectively. Thus, the printing sheet is precisely transported in the printing area, and during the transportation, predetermined tension is applied to the printing sheet to keep it flat over a wide area.

FIG. 11 is a sectional view mainly showing the transporting mechanism for the printing sheet in a conventional example of a printing apparatus based on an ink jet method.

In the figure, a printing head 7 mounted in a carriage portion 5 executes a scanning operation in a direction perpendicular to the drawing sheet, and during the scanning operation, ejects ink for performing a printing operation. In relation to the printing area covered by the printing head, a printing sheet P is transported, under the carriage portion 5, from right to left in the figure with substantially keeping its horizontal position. More specifically, as the above-stated two pairs of transportation mechanisms, a pair of a transportation roller (hereinafter referred to as "LF roller") 36 and a pinch roller 37 is provided in an upstream side of the printing area, in which the printing sheet is transported, and a pair of a sheet discharging roller 41 and a spur 42 is provided in a downstream side of the printing area. Among these rollers, the pinch roller 37 is rotatably supported on a rotation shaft provided in a pinch roller holder 30. The pinch roller holder 30 is urged by a pinch roller spring 31 so that the pinch roller 37 can be pressed against the transportation roller 36. A pressing mechanism (not shown) similarly applies pressing force which is applied between the sheet discharging roller 41 and the spur 42. The two pairs of rollers respectively hold the printing sheet P therebetween, and a driving mechanism (not shown) rotationally drives the transportation roller 36 and the sheet discharging roller 41, thereby causing the printing sheet P to be transported a predetermined distance for each one scanning operation of the printing head.

However, it is known that the above-described transportation mechanism may cause a deviation of transporting position of the printing sheet: when the printing sheet P is transported and a back end thereof slips out from the transportation roller 36 and the pinch roller 37 holding the printing sheet therebetween, the printing sheet P may be transported more than a expected predetermined distance, thereby a relative position of the printing head to the printing sheet P deviating from the regular one. As a result, a position (position of an printed image) of an ink dot formed on the printing sheet P with ink ejected from the printing head deviates from a standard position, thereby degrading the printed image.

FIGS. 12A and 12B show a positional relationship between the transportation roller 36 and the pinch roller 37. As shown in FIG. 12B, the transportation roller 36 has a length corresponding to a width of the printing sheet P. On the other hand, a plurality of pinch rollers 37, each of which is shorter than the transportation roller 36, are disposed correspondingly to the transportation roller. With this configuration, when the back end of the printing sheet P slips out from the transportation roller 36 and the pinch rollers 37, the pinch rollers 37 move toward the transportation roller a distance corresponding to a thickness of the printing sheet P, which has been held by the pinch rollers 37 and the transportation roller 37 between there. Urging force of the pinch roller 37 associated with this movement causes the printing sheet P to be transported an extra distance, that is, longer than the expected predetermined distance. At the same time, the transportation roller rotates an amount corresponding to the above extra transported distance.

Thus, when the back end of the print sheet slips out from between the transportation roller 36 and the pinch roller 37, the pinch roller 37 moves to the position at which it abuts against the outer peripheral surface of the transportation roller to have its position stabilized. Frictional resistance that may occur between the pinch roller 37 and the print sheet and the transportation roller 36 may vary slightly due to an environment or the like. Such a variation in frictional force may cause the transportation roller to be stopped while the roller is unstable. In this case, during a printing operation, the movement of the carriage or the like may cause the transportation roller to rotate to a stabilized position to transfer the print sheet. That is, the image, which should be printed along the main scanning direction, may be printed obliquely in a direction crossing the main scanning direction, thus degrading image quality.

Further, to deal with the above error in transportation, it is contemplated that for example, a brake may be provided to stop rotation of the transportation roller to restrain the print sheet P from being transported an extra distance when the sheet slips out. However, in this case, load torque required to drive the transportation roller increases, so that disadvantageously, a higher-grade drive motor must be used, and transportation speed cannot be increased.

SUMMARY OF THE INVENTION

The present invention is provided to solve these problems, and it is an object thereof to provide a printing apparatus and method that can use a simple configuration to reduce the deviate of an image printed position caused by inappropriate transportation of a print sheet during a printing operation which transportation may occur when the back end of the sheet slips out from a transporting means.

Thus, the present invention has the following configuration:

A printing apparatus including transporting means for transporting a print medium relative to printing means for printing an image on a print sheet is characterized by further comprising vibrating means for vibrating the transporting means before the printing means start a printing operation.

Further, a printing method which includes transporting means for transporting a print medium relative to printing means for printing an image on a print sheet and which uses the transporting means to transport the print medium after the printing means has performed a printing operation is characterized by comprising the step of vibrating the transporting means before the printing means start the printing operation.

With the above configuration, before the printing means performs a printing operation on the print medium, the transporting means is vibrated. Thus, if the transportation roller is at a position where it sits unstably, image corrections can be executed after the roller is stopped at a position where it sits stably. This prevents disturbed image printing, that is, oblique printing caused by slight movement of the transportation roller during a printing operation, thereby obtaining a high-quality image.

Further, the present invention requires no brake mechanism that prevents inappropriate movement of the print medium, thereby precluding load torque required for the transporting means from increasing unnecessarily.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

<Embodiment 1>

A printing apparatus according to this embodiment has an automatic sheet feeding unit installed therein, and in this state, has mechanism sections including the sheet feeding unit, a sheet transporting section, a sheet discharging section, a carriage section, and a cleaning section. Further, in addition to these mechanism sections, the printing apparatus is equipped with a control section in the form of a substrate which control an operation of each mechanism section, described later, and which executes processing for printing data, transportation of a printing sheet or the like. The control section has a CPU, a ROM, a RAM and others as in a case with well-known printing apparatuses. Further, printing heads used in this printing apparatus are based on an ink jet method. Specifically, the printing heads employ what is called the BJ method which uses thermal energy generated by an electric-thermal transforming element to generate a bubble in ink to allow the ink to be ejected using pressure of the bubble.

Figure 3:
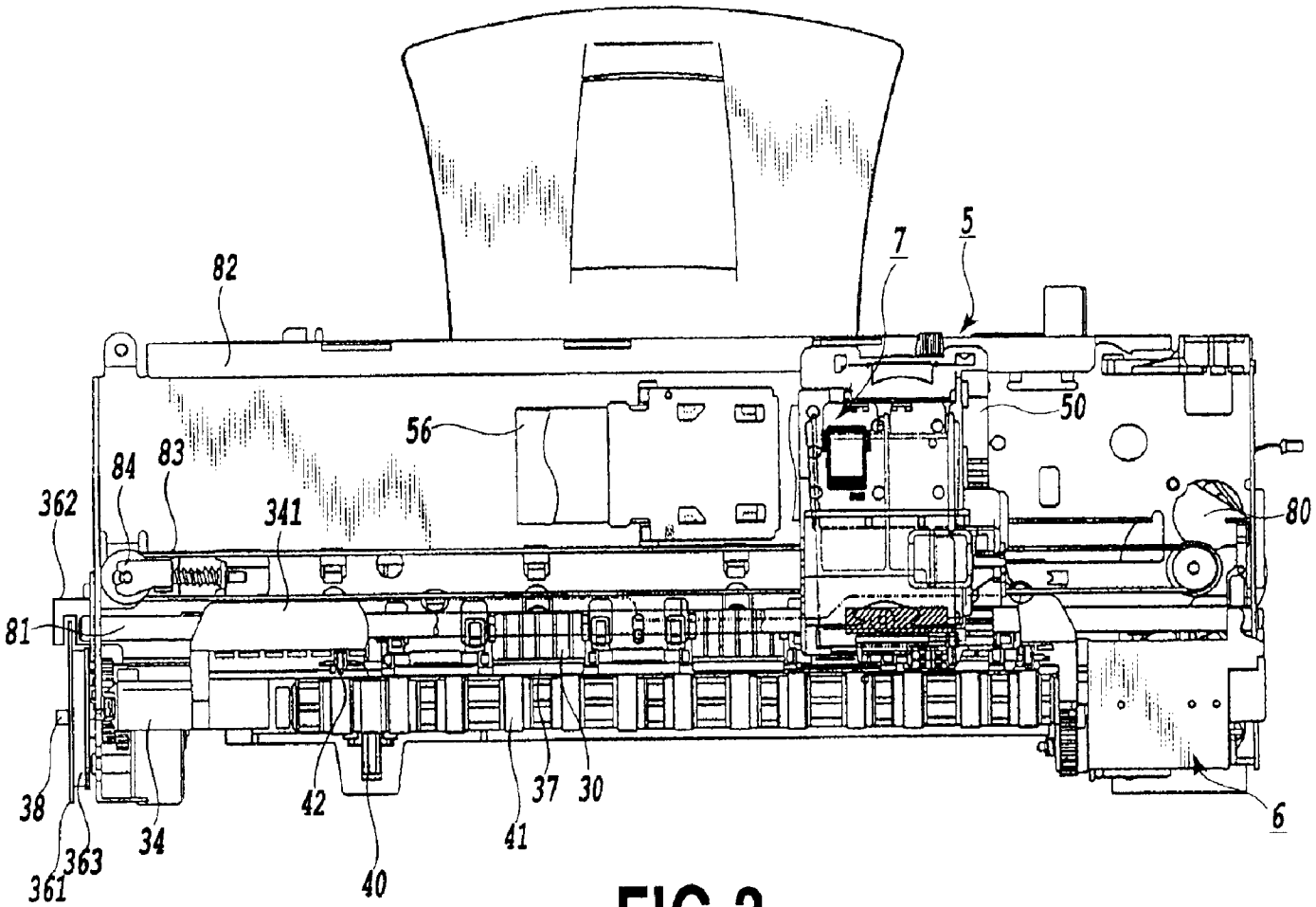
FIG. 3 is a plan view of a printing apparatus according to the first embodiment of the present invention.
Figure 4:
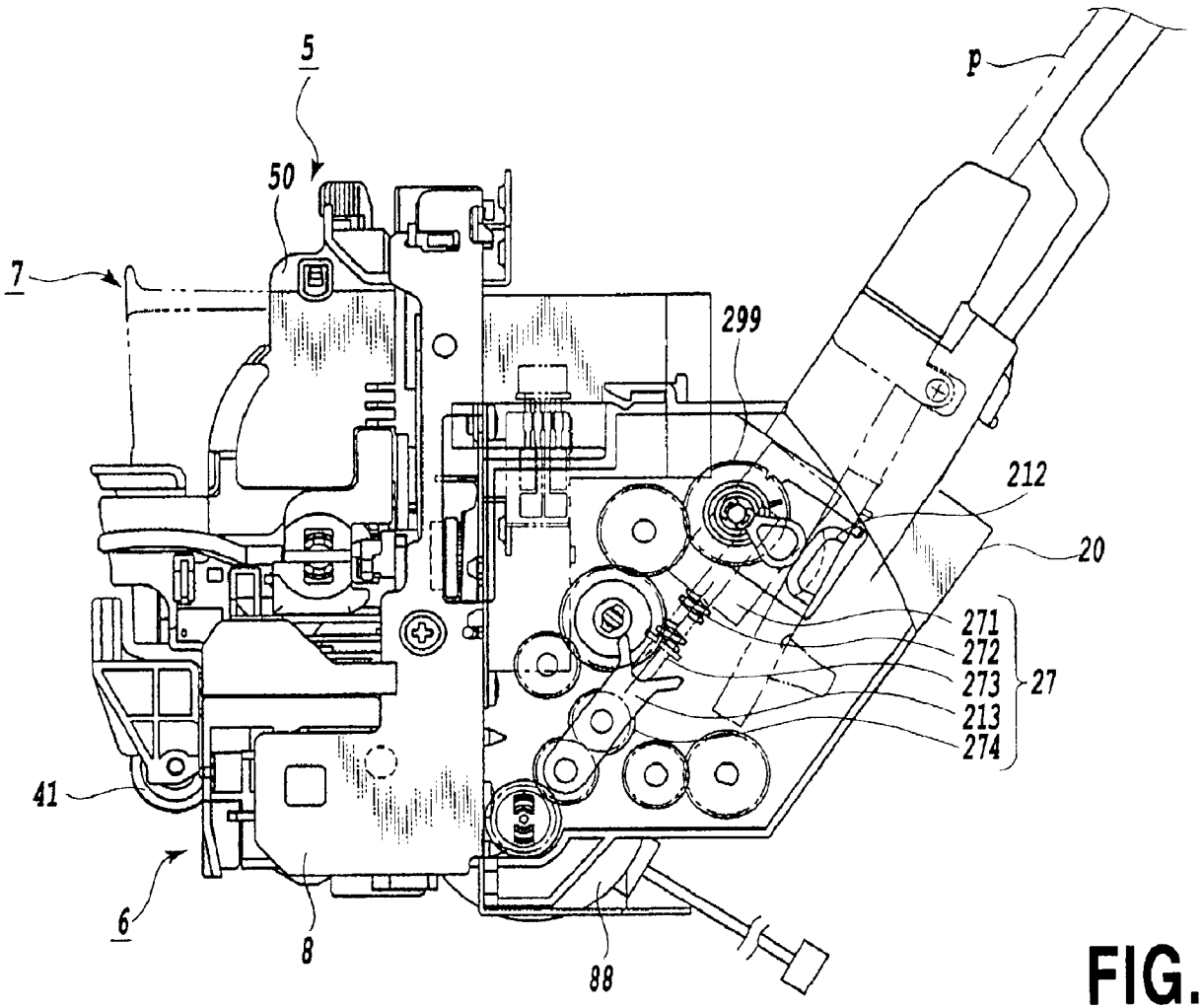
FIG. 4 is a side view of the printing apparatus.
Figure 5:
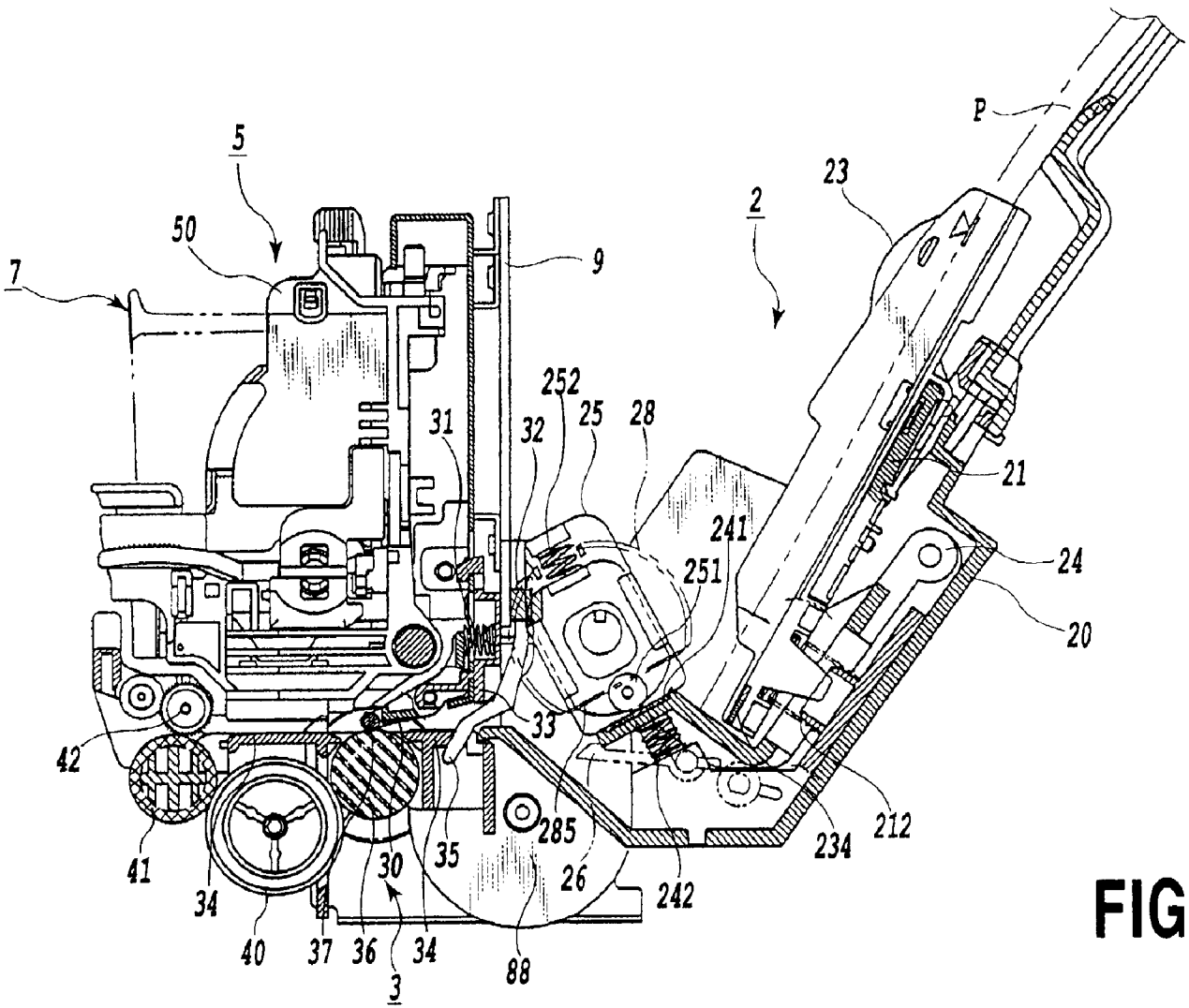
FIG. 5 is a transverse sectional view of the printing apparatus.

The mechanism sections are shown in FIGS. 3 to 5. FIG. 3 is a front view of this printing apparatus, FIG. 4 is a side view thereof, and FIG. 5 is a traverse sectional view thereof. The above mentioned mechanism sections will be described below mainly with reference to the transverse sectional view of this printing apparatus shown in FIG. 5.

(A) Sheet Feeding Section (Sheet Feeding Unit)

In FIG. 5, the sheet feeding section 2 is constructed by installing the automatic sheet feeding unit in the printing apparatus main body. The automatic sheet feeding unit has a base 20, which is provided with a pressure plate 21 on which printing sheets P are loaded and a sheet feeding roller 28 that feeds the printing sheet P. The sheet feeding roller 28 has a D-shaped cross section formed by partially cutting a circle. The pressure plate 21 is equipped with a movable side guide 23 that can restrict the loaded position of the printing sheets P. The pressure plate 21 is rotatable around a rotating shaft formed on the base 20 so that the urging force of a pressure plate spring 212 can urge the printing sheets P loaded thereon toward the sheet feeding roller 28. Further, the pressure plate 21 and the movable side guide 23 have separating pads 213 (see FIG. 4) and 234 installed in sites thereof opposite to the sheet feeding roller 28 to prevent a plurality of printing sheets P from being fed with overlapping each other, the separating pads being each composed of a material such as artificial leather which has a large friction coefficient.

Further, the base 20 is equipped with a separating pad holder 24 which is rotatable around the rotating shaft installed on the base 20 and which is equipped with a separating pad 241 to separate the printing sheets P from one another. The printing sheets P are urged toward the sheet feeding roller 28 by a separating pad spring 242. Further, against the separating pad holder 24, a rotating roller holder 25, which has a rotating roller 251 mounted thereon, is urged in the direction opposite to the above urging direction by a rotating roller spring 252.

The automatic sheet feeding unit is equipped with a release cam gear 299 (see FIG. 4) to release the contact of the pressure plate 21 (or the printing sheets P loaded thereon) with the sheet feeding roller 28. Rotation of the gear is set so that when the pressure plate 21 lowers to a predetermined position, a cut portion 285 of the sheet feeding roller 28 is located opposite the separating pad 241. Thus, a predetermined space can be formed between the separating pad 241 and the sheet feeding roller 28. At the same time, the rotating roller 251 contacts with the separating pad 241 to prevent a plurality of printing sheets from being fed with overlapping each other.

As described above, in a standby state, the release cam gear 299 pushes the pressure plate 21 down to a predetermined position to clear the contact between the pressure plate 21 and the sheet feeding roller 28 and between the separating pad 241 and the sheet feeding roller 28. Then, in this state, when driving force applied to drive a transportation roller 36 of the sheet transporting section 3, described later, is transmitted to the sheet feeding roller 28 and the release cam 299 via a gear or the like, the release cam 299 leaves the pressure plate 21, which is thus elevated to cause the sheet feeding roller 28 to contact with the printing sheet P. As the sheet feeding roller 28 rotates, the printing sheet P are picked up and are then separated from one another by the separating pad 241 and fed to the sheet transporting section 3. Then, once the printing sheets P has been fed into the sheet transporting section 3, the contact of the sheet feeding roller 28 with both the pressure plate 21 and the separating pad 241 is cleared by the release cam gear 299. Furthermore, once the fed printing sheet P has been completely printed and discharged, a return lever 26 acts on the printing sheets P placed on the separating pad 241 to allow the printing sheets P to be returned to their loaded position on the pressure plate 21.

The return lever 26 and the sheet feeding roller 28 are driven by driving force for the transportation roller 36 transmitted via predetermined gears. The transmission of the driving force is switched by a solenoid 271, solenoid spring 272, solenoid pin 273, and planetary gear arm 274 of a drive switching section 27 (see FIG. 2). More specifically, when the solenoid pin 273 acts on the planetary gear arm 274 to restrict its movement, the driving force for the transportation roller 36 is not transmitted. On the other hand, when the solenoid pin 273 is separated from the planetary gear arm 274, the planetary gear arm 274 becomes free to transmit the driving force to the return lever 26 and the sheet feeding roller 28 as the transportation roller 36 rotates forward or backward.

(B) Sheet Transporting Section

A chassis 8 (see FIG. 4) formed by bending a sheet metal and constituting a structural member of the printing apparatus main body has elements mounted thereon, which constitutes the sheet transporting section 3. More specifically, the sheet transporting section 3 is constructed by including a pair of the transportation roller 36 and a pinch roller 37, provided at an upstream side of the printing area covered by the printing head, in the transporting direction, and a pair of a sheet discharging roller 41 and a spur 42, provided at a downstream side of the printing area in the same direction. The transportation roller 36 is formed by coating the surface of a metal shaft with ceramic particles, and has shafts installed at the respective ends thereof and each supported by one of the two bearings 38 (One of them is shown in FIG. 3. The other is not shown) installed at the respective ends of a chassis 8.

A plurality of pinch rollers 37, which follow each other, are provided so that they can contact with the transportation roller 36. The pinch rollers 37 are held by a pinch roller holder 30, and when the holder is urged by a pinch roller spring 31, the pinch rollers 37 comes into pressure contact with the transportation roller 36 to generate force required to transport the printing sheet P. At this time, a rotating shaft of the pinch roller holder 30 is mounted on a bearing of an upper guide 33 installed on the chassis 8, and the pinch roller holder 30 rotates around this shaft. The pinch roller holder 30 is integrally formed and has fixed or higher rigidity in a direction in which the printing sheets P are transported. By further setting relatively low rigidity in a direction perpendicular to the above transportation direction, the urging force of the pinch roller spring 31 appropriately acts on the pinch rollers 37. Further, all the pinch rollers 37 are constructed substantially parallel with the rotating shaft of the transportation roller 36 (see FIG. 1) as described above. The pinch roller holder 30 and the upper guide 33 also act as a guide for the printing sheets P. Furthermore, an inlet of the sheet transporting section 3, to which the printing sheet P is transported from the above described sheet feeding portion 2, has a platen 34 disposed thereat to guide the printing sheet P. Further, the upper guide 33 is equipped with a PE sensor lever 35 that activates a PE sensor 32 for detecting front and back ends of the printing sheet P. Additionally, the platen 34 is mounted and positioned on the chassis 8. The pinch rollers 37 according to this embodiment are formed of resin such as POM which allows an object to slide well thereon, and each have an outer diameter set between about $\phi 3$ and 7 mm.

Further, the platen 34 has a sheet presser (not shown) installed on a sheet reference side thereof and which covers the corresponding end of the printing sheet P. Thus, even if the end of the printing sheet P is deformed or curved, it is prevented from floating to interfere with a carriage 50 or printing heads 7.

A carriage portion 5, described later, is constructed above the sheet transporting section 3. The carriage portion has the printing heads 7 mounted thereon and which perform a scanning operation to eject ink to the printing sheet P for printing, the printing sheet P being transported by the pair of the transportation roller 36 and the pinch roller 37 and the pair of the sheet discharging roller 41 and the spur 42. In this printing operation, the printing sheet P that has been fed to the sheet transporting section 3 is guided to the pair of the transportation roller 36 and the pinch roller 37 by the platen 34, the pinch roller holder 30, and the upper guide 33. At this time, the PE sensor lever is operated by the front end of the transported printing sheet P, to detect the front end of the printing sheet P. Then, based on the result of the detection, a printing position on the printing sheet P can be determined. Further, an LF motor 88 drives and rotates the pair of the rollers 36 and 37 to transport the printing sheet P on the platen 34, and the transportation roller 36 has an encoder wheel 361 (see FIG. 3) mounted thereon to detect the rotary position thereof. The encoder wheel 361 is composed of a disk-shaped transparent sheet having radial markings formed thereon at predetermined pitches. The rotary position or quantity of rotation of the transportation roller 36 can be determined when an optical encoder sensor 362 (see FIG. 3) fixed to the chassis 8 detects these marks.

The carriage portion 5, as described before, has the printing heads 7 and ink tanks from which black and color inks are supplied to the printing heads 7, which are individually arranged for the respective ink colors and individually detachable from the carriage. Also as described above, the printing head 7 has a heater to heat the ink so that film boiling is caused in the ink to generate a bubble, and change in pressure caused by grow or contract of the bubble causes the ink to be ejected from the nozzles of the printing heads 7. Thus, printing of an image on the printing sheet P can be performed. The printing heads 7 for the respective color inks have the nozzles, constituting printing elements, arranged parallel with the direction in which the printing sheet is transported. Thus, inoperative nozzles can be set and this setting can be used to execute corrections according to an error in transportation of the printing sheet, as described later with reference to FIGS. 8B and 8C.

(C) Carriage Portion

The carriage portion 5 has a carriage 50, to which the printing heads 7 are mounted. The carriage 50 is supported by a guide shaft 81 (see FIG. 3) extending in the direction perpendicular to the direction in which the printing sheet P is transported and a similarly extending guide rail 82 (see FIG. 1) that holds a rear end of the carriage 50 to maintain a gap between the printing heads 7 and the printing sheet P.

Further, the carriage 50 is driven by a carriage motor 80 (see FIG. 3), which is mounted on the chassis 8, via a timing belt 83 (see FIG. 3). The timing belt 83 is extended and supported by idle pulleys 84 (see FIG. 3). Furthermore, the carriage 50 is equipped with a flexible substrate 56 (see FIG. 3) to transmit printing signals or the like from an electric substrate 9 constituting the above described control section, to the printing heads 7.

With the above configuration, for printing on the printing sheet P, the pair of the rollers 36 and 37 transports the printing sheet P to a row position to be printed (a position on the printing sheet P in the transportation direction), and the carriage motor 80 moves the carriage 50 to a column position to be printed (a position on the printing sheet P in the direction perpendicular to the transportation direction) to scan the printing heads 7 on the printing sheet. Then, during this scanning operation, on the basis of printing signals or the like from the control section, the printing heads 7 are driven to eject the ink to the printing sheet P, thereby printing the image or the like.

(D) Sheet Discharging Section

The pair of the sheet discharging roller and spur in the sheet transporting section constitute a sheet discharging section. More specifically, a spur base 341 (see FIG. 3) has the spurs 42 rotatably provided therein correspondingly to the sheet discharging rollers 41 and against which the spurs are contacted. The sheet discharging rollers 41 can be driven by that a transmission roller 40 transmits driving force for the transportation roller 36 to the sheet discharging roller.

The sheet discharging rollers 41 is formed as a plurality of roller portions each of which is made of a high-friction material such as rubber, and is disposed on a shaft consisting of metal or resin (see FIG. 3). Further, each of the spurs 42 has a thickness of about 0.1 mm, has protrusions formed on its outer circumference, and is composed of a metal plate such as SUS (stainless steel) and a resin portion consisting of POM and forming a rotating bearing.

The transmission roller 40, which transmits driving force to the sheet discharging roller 41, is disk shaped, is composed of POM or the like, and has a low-hardness and high-friction material such as styrene-based elastomer attached on the outer circumference thereof. The transmission roller 40 is contacted against both the transportation roller 36 and the sheet discharging roller 41 at a predetermined pressure, thereby transmitting driving force therebetween.

With the above configuration, the printing sheet P on which printing has been carried out through a scanning operation of the printing heads of the carriage portion 5 is transported with being held by nipping of the sheet discharging roller 41 and spur 42, and is then discharged to a sheet discharging tray or the like. During this transportation, once the back end of the printing sheet P has slipped out from the transportation roller 36 and the pinch roller 37, the printing sheet P is transported or discharged with being held only by the sheet discharging roller 41 and spur 42 of the sheet discharging section. Then, a printing operation is performed or the printing sheet is discharged. Further, a spur cleaner contacts with each of the spurs 42 to enable ink and the like deposited on the spur 42 to be removed.

(E) Cleaning Section

A cleaning section 6 (see FIGS. 3 and 4) has a pump (not shown) used for ejection recovery operation for the printing heads 7 and a cap (not shown) that restrains the ink in each nozzle of the printing head from drying.

Figure 6:
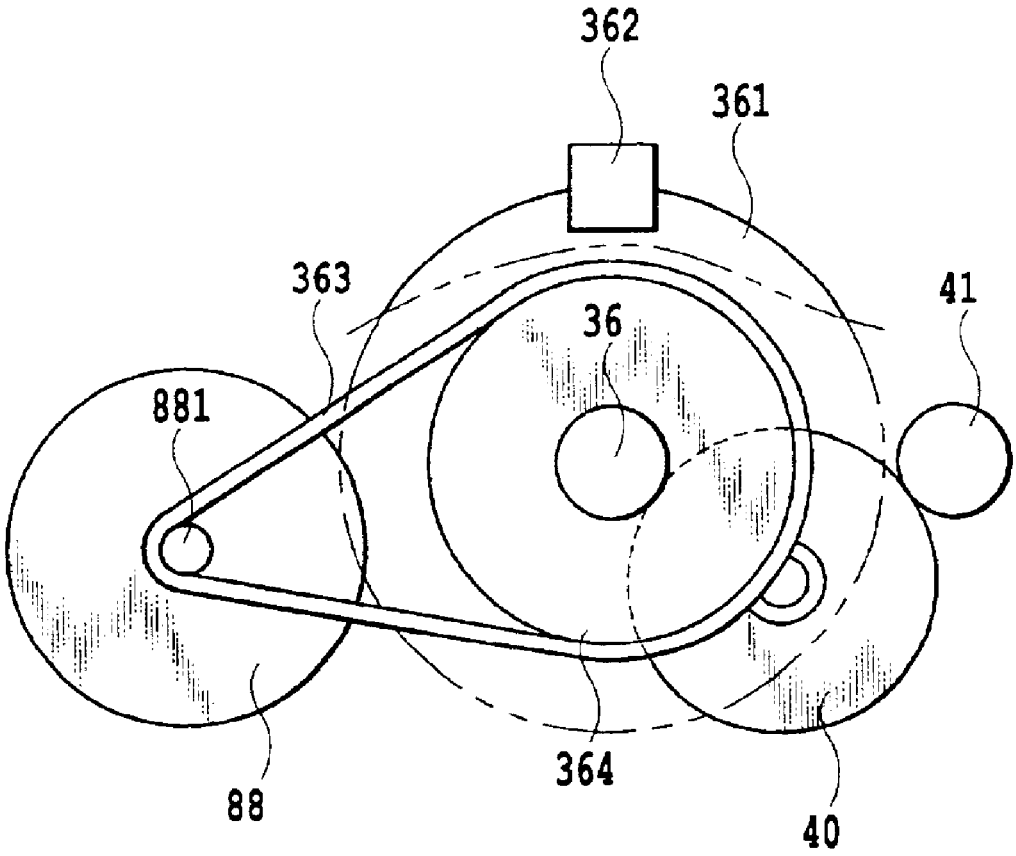
FIG. 6 is a view showing a mechanism that mainly detects the quantity of rotations of a transportation roller of the printing apparatus.

FIG. 6 is a view useful in describing a detection mechanism that detects a rotary position or quantity of rotation of the transportation roller 36.

As described above, the transportation roller 36 has an encoder wheel 361 mounted thereon. Specifically, the encoder wheel 361 can be centered by press fitting it to the rotating shaft of the transportation roller 36, and is bonded to an LF pulley 364 to increase its strength. The encoder wheel 361 is, as shown in FIG. 4, a disk-shaped, and transparent sheet, and has radial markings formed thereon at predetermined pitches. With respect to the encoder wheel, an optical encoder sensor 362 is provided in a fixed state for detecting the markings on the encoder wheel 361 to determine the rotary position or quantity of rotation of the transportation roller 36. That is, each time any of the marks on the encoder wheel 361 reaches the position of the encoder sensor 362 as the transportation roller 36 rotates, a corresponding detection signal is generated and transmitted to the control section. The control section counts the number of detection signals starting with a predetermined reference rotary position to determine the rotary position or quantity of rotation of the transportation roller 36. The detected quantity of rotation can be used for an image position correcting process, described later in FIGS. 8A to 8C.

The transportation roller 36 is driven by transmitting the driving force of the LF motor 88 via an LF belt 363, as shown in FIG. 6. More specifically, the above transmission can be carried out by installing an LF belt 363, at a predetermined pressure, on an LF motor pulley 881 attached to the LF motor 88 and on an LF pulley 364 attached to the transportation roller 36. Further, FIG. 6 shows configuration that transmits the driving force for the transportation roller 36 to the sheet discharging roller via the transmission roller 40, described previously.

Next, a printing operation performed by the above configuration will be described with reference to FIGS. 1, 2, 7, and 8. Before a rear end of the print sheet P reaches to a printing area by a transportation roller (step 900), a printing is performed by step 907.

Figure 1:
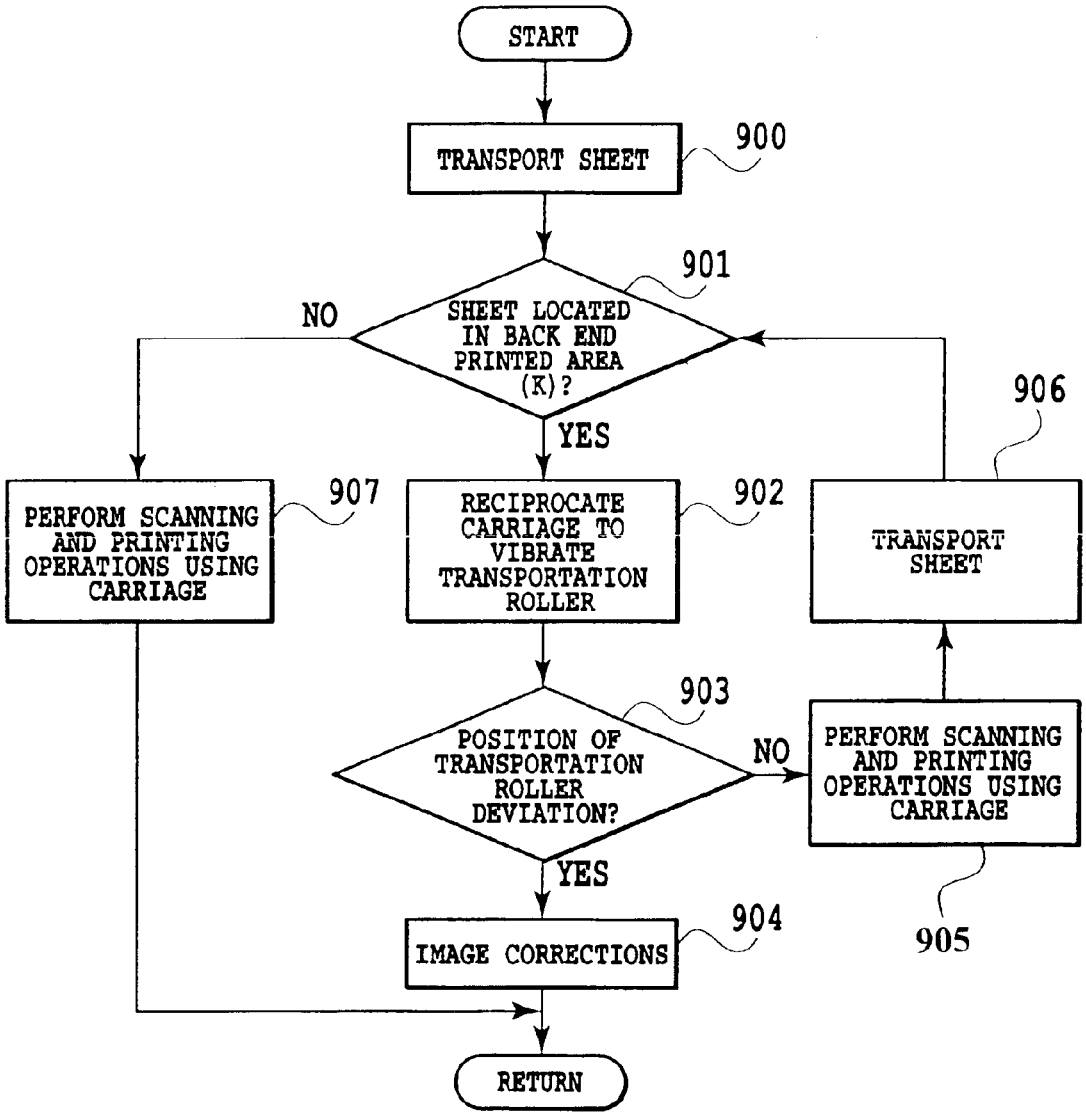
FIG. 1 is a flow chart showing a printing operation according to a first embodiment of the present invention.
Figure 2:
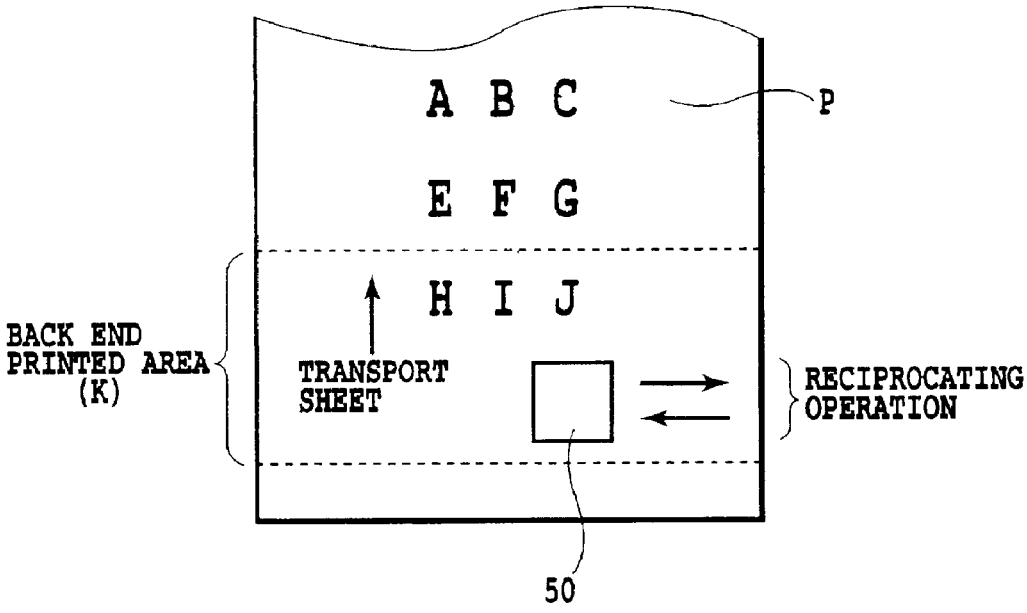
FIG. 2 is a view useful in describing the printing operation according to the first embodiment of the present invention.

As shown in FIGS. 1 and 2, the print sheet P is transported (step 900), and if its back end reaches a back end printed area (K), that is, a predetermined range close to the nips of the transportation roller 36 and the pinch roller 37 (step 901), then the carriage is reciprocated (step 902) to vibrate the transportation roller 36. As a result, the encoder wheel 361 and the encoder sensor 362 determine whether or not the pinch roller 37 is deviate from its appropriate position relative to the transportation roller 36 (step 903). Since the carriage is moved to vibrate the transportation roller 36, no image is formed or no ink is ejected from the print heads. In this case, if the transportation roller is not deviate from its appropriate position, a carriage scanning operation is performed to eject ink from the print heads to form an image (step 905), the print sheet P is transported again (step S906), and the process returns to step 901.

Further, when the print sheet P slips out from the downstream nip portions of the transportation roller 36 and pinch roller 37, the transportation roller may be rotated due to the pressing force of the pinch roller 37 and thus deviate from its appropriate rotating position, as described previously. In this case, image corrections are executed (step 904) as described later. If the transportation roller 36 is rotated in this manner, it becomes stable.

The transportation roller 36 may rest at any appropriate rotary position where the pressing force of the pinch roller 37 and rotational sliding resistance from the transportation roller 36 are balanced. In this case, if in this balanced state, a printing operation is performed by moving the carriage as in the prior art (S907), then vibration associated with this operation may clear the well-balanced stopped state of the transporting roller 36 to rotate the roller 36 during the printing operation. If the transportation roller is rotated during the printing operation, the image to be formed along the main scanning direction (carriage moving direction) may be obliquely printed to degrade image quality.

Then, in this embodiment, after the print sheet has been transported (step 900), the carriage 5 is reciprocated to vibrate the transportation roller 36. Thus, if the transportation roller is in an unbalanced state, it is rotated to a stabilized position where it is no longer rotated. This rotation of the transportation roller 36 may deviate the printed position. Thus, to prevent the image from being degraded due to this deviate, the image corrections described later are executed before the image is formed. This enables an undisturbed high-quality image to be formed. Vibration caused by the carriage 5 is transmitted from the guide shaft 81 to the transportation roller 36 via the chassis 8.

The printing operation performed by the printing apparatus of the embodiment described above, notably the image position correction, will be described with reference to FIGS. 7 and 8.

Figure 7:
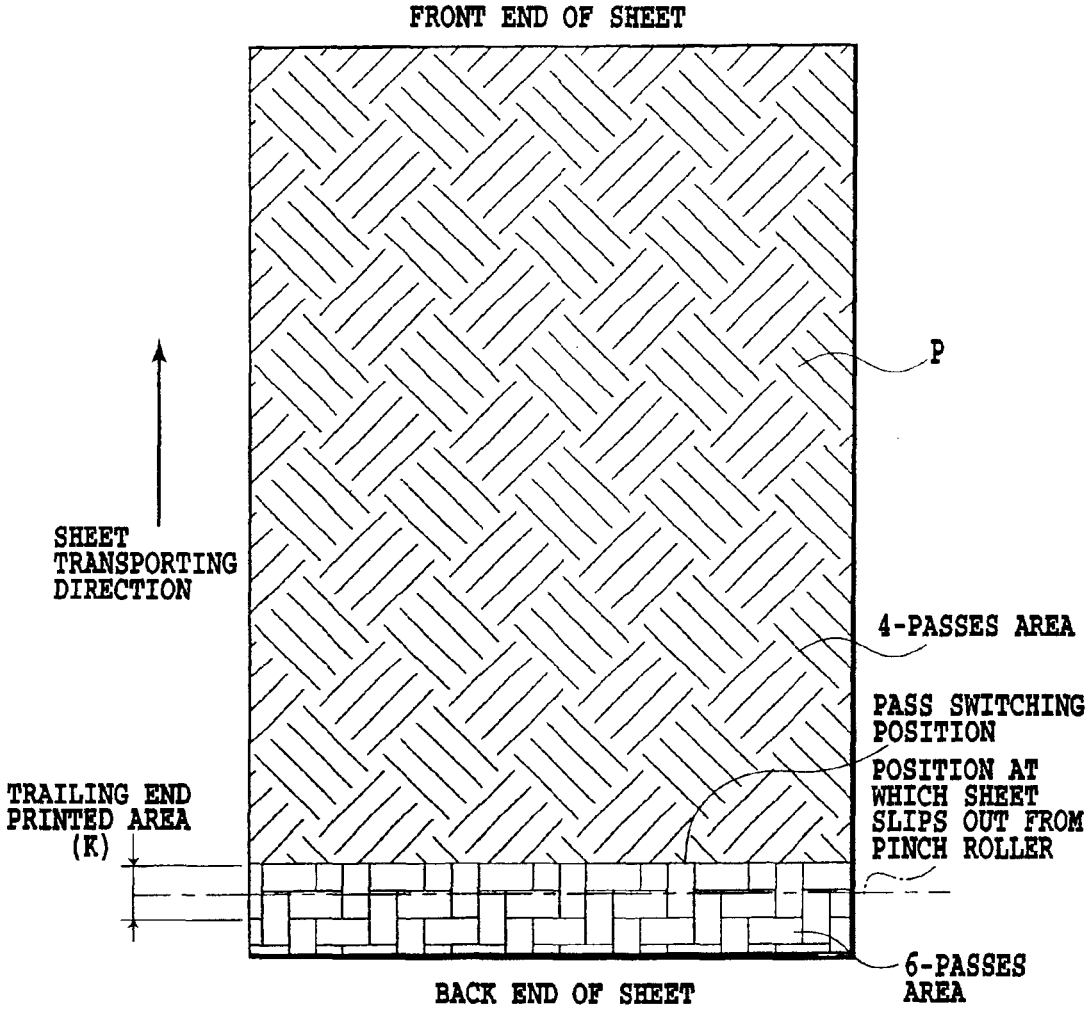
FIG. 7 is a view showing print control according to the first embodiment of the present invention on the basis of printed areas of a print sheet.
Figure 8A:
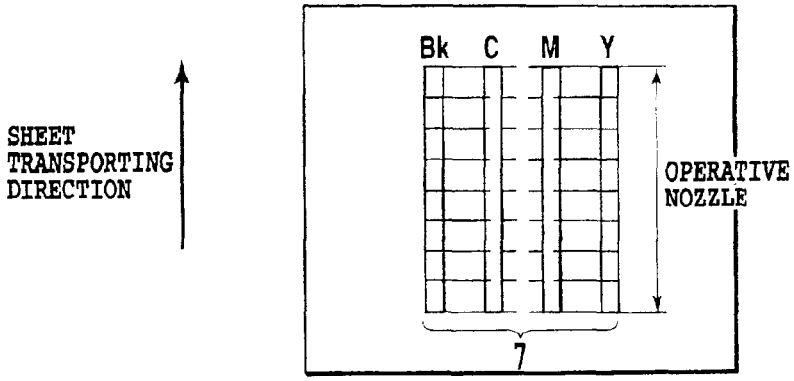
FIGS. 8A to 8C are views useful in describing the print control for each printed area.
Figure 8B:
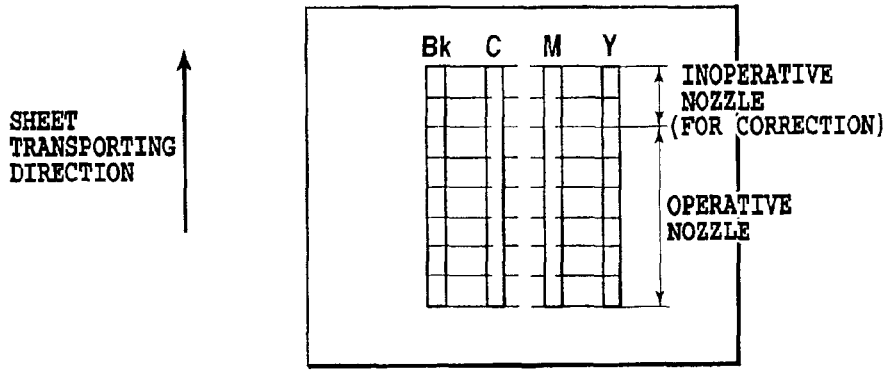
Figure 8C:
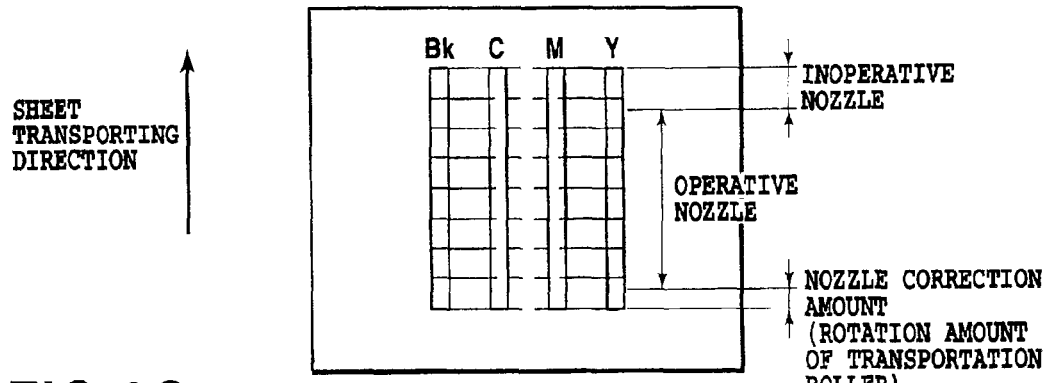

FIG. 7 is a view for explaining a process of controlling the printing operation differently for each area of the printing sheet and the like. FIGS. 8A to 8C show an operative range of the nozzles of the printing heads for each of the different printing control processes.

In this embodiment, a multipass printing process is executed in which a printing area printed through a scanning operation performed by the printing heads is printed through a plurality times of scanning operation and different nozzles are used for the respective scanning operations. In this embodiment, the multipass printing process is controlled differently between an area completely printed through four scanning operations (4-passes area) and an area completely printed through six scanning operations (6-passes area), as shown in FIG. 5. More specifically, in the 4-passes area, four nozzle blocks obtained by dividing all the nozzles of the printing heads into four are used, and the normal printing operation shown in FIG. 8A is performed in the corresponding areas. In the 6-passes area, six nozzle blocks obtained by dividing six-eighths of all the nozzles into six are used, and basically the after-pass-switch printing operation shown in FIG. 8B is performed.

In the transportation for printing on a back end portion of the printing sheet P, the back end of the printing sheet slips out from the pair of the transportation roller and pinch roller, located upstream, and is transported only by the pair of the sheet discharging roller and the spur, located downstream. In this case, since transportation accuracy may decrease, an amount of printing sheet transported during a single transporting operation is reduced to lessen possible transportation errors. At the same time, the number of times of scanning operation for the same printing area in the multi-pass printing process is increased to make unevenness of print density, which may be caused by the above transportation errors, unnoticeable. Because of this, in this embodiment, the 6-passes area is provided correspondingly to the back end portion of the printing sheet transported, so that the amount of printing sheet transported during a single transporting operation is smaller than in the 4-pass area and six passes (six times of scanning operation) are executed.

The number of passes is controlled to be switched when the "pass switching position" of the printing sheet P, shown in FIG. 7, reaches the position at the pair of the transportation roller 36 and the pinch roller 37 in the transportation of the printing sheet. This position can be detected by, for example, detecting the front end of the printing sheet and then detecting that a predetermined number of transporting operations (or a predetermined amount of rotation of the transportation roller) corresponding to this position have been performed from detecting of the front end.

In the transportation of the printing sheet, when the printing sheet passes the above pass switching position and then reaches the position at which the printing sheet slips out from the transportation roller and the pinch roller (the back end of the printing sheet leaves the pair of the rollers 36 and 37), basically the after-pass-switch printing operation is performed shown in FIG. 8B. However, as described below, when it has been detected that the printing sheet has been transported a distance longer than a predetermined one, then immediately after the detection, the after-nozzle-shift printing operation shown in FIG. 8C is performed.

During the normal printing operation shown in FIG. 8A, each of the printing heads 7 for black (Bk), cyan (C), magenta (M), and yellow (Y) uses all the nozzles to perform the 4-passes printing operation. Accordingly, the amount of printing sheet P transported during a single transporting operation is one-fourth of the entire nozzle arranged length, so that a printing area corresponding to the above one-fourth distance is completely printed through four times of scanning operation performed by the printing heads. As the printing sheet P is transported, the 4-passes printing operation is continuously performed until the above described "pass switching position" of the printing sheet P is reached, thereby completing printing this 4-pass area. In the final stage in which the 4-passes area is completely printed, some of the nozzles of each printing head are opposite to the 6-passes area. Thus, to avoid using these nozzles, the operative portion of the nozzles are shifted correspondingly to the amount of printing sheet transported during a single transporting operation, thus first completing printing only the 4-pass area. The switching between the numbers of passes is controlled in this manner in order to simplify software used, and of course the switching process is not limited to the above example.

Once the 4-passes area has been completely printed, the after-pass-switch printing operation shown in FIG. 8B is performed, that is, the operation is switched to the 6-pass printing. During this printing operation, the operative portion of the nozzles is limited by setting some of the operative nozzles of each printing head 7 as an inoperative portion. In this embodiment, two-eighths of the nozzles are set as an inoperative portion, with the remaining six-eighths of the nozzles used for printing. Since this operative range is used to perform the 6-pass printing operation, the amount of printing sheet P transported during a single transporting operation corresponds to one-eighth of the entire nozzle range length.

In the 6-pass printing operation, when the back end of the printing sheet P slips out from the transportation roller 36 and the pinch roller 37, the transportation roller 36 may be rotated more than a predetermined distance due to the pressure exerted by the pinch roller 37, as described before. This extra rotation is detected by the encoder wheel 361 and the encoder sensor 362, the extra amount of rotation of the transportation roller 36 is detected. Then, a correction amount is determined based on the detected extra amount, as shown in FIG. 8C, to shift the operative portion of the nozzles of each printing head 7 at a distance corresponding to the extra amount of rotation using the inoperative portion of the nozzles.

More specifically, the control section, which executes data processing and control of operations in the printing apparatus, for example refers to a table by the detected extra amount, obtains a number of nozzles corresponding to the extra rotation amount, and supplies printing data to a head driver so as to shift the operative nozzles as a whole correspondingly to the obtained the number of nozzles. Strictly, though the detected extra amount does not always coincide with a sift amount, the above table is configured so that the most approximate shift amount is set to the detected extra amount. With the above processing, the operative portion of the nozzles of each printing head is shifted relative to the printing sheet P, which has been transported the extra distance, thereby preventing the position of the image printed on the printing sheet from deviating from parts of the image printed during previous scanning operations. Thus, according to this embodiment, even with the relative positional deviation of the printing head position from the printing sheet position, which may occur because the printing sheet is transported the extra distance when it slips out from the upstream roller pair, an appropriate printing operation can be performed without any printing degradation such as the positional deviation of the printed image.

Further, if the positional deviate of the transportation roller 36 is detected in step 903 in FIG. 1, then it may be corrected by rotationally driving the transportation roller to the appropriate position again in addition to carrying out the above described nozzle shift.

Thus, a good image can be formed with few printing errors.

<Second Embodiment>

Now, a second embodiment of the present invention will be described.

In the first embodiment, the carriage 50 is reciprocated to vibrate the transporting means, but in the second embodiment, the transporting means is vibrated by moving the pressure plate 21 of the sheet feeding section in the vertical direction.

Figure 9:
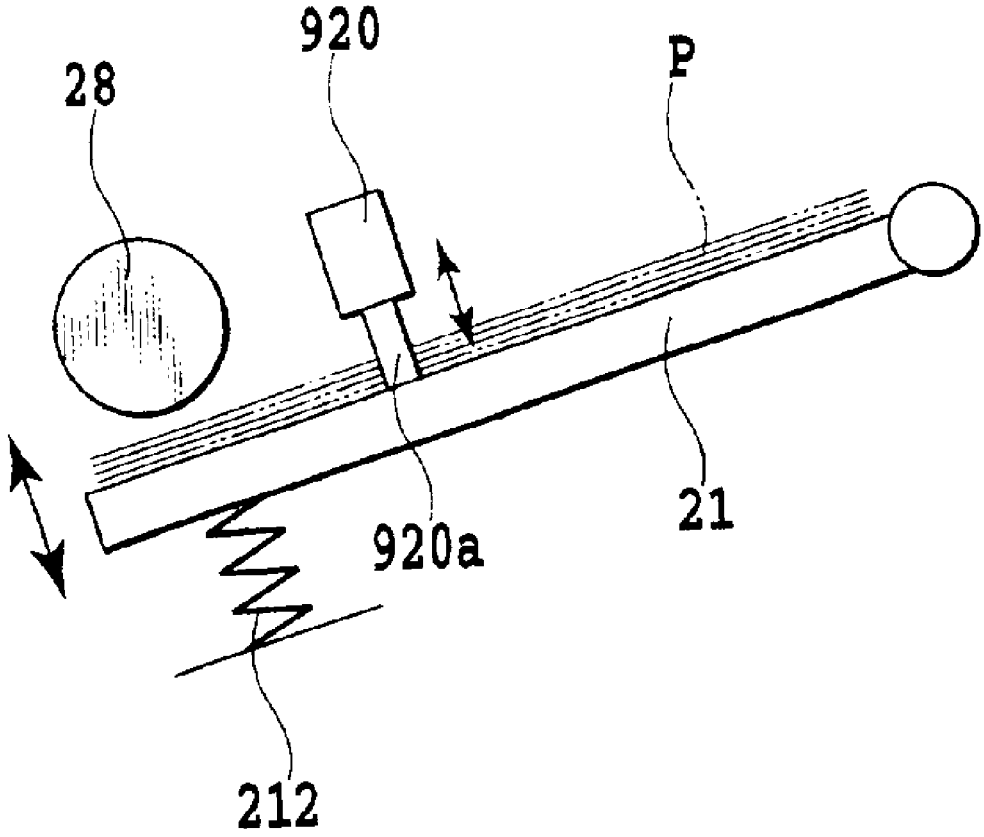
FIG. 9 is a side view useful in describing vibrating means according to a second embodiment of the present invention.

That is, in the first embodiment, the release cam gear 299 and the sheet feeding roller 28 operate in an interlocking manner, so that when the pressure plate 21 operates, the sheet feeding roller 28 rotates to feed a sheet. In contrast, in the second embodiment of the present invention, the linkage between the pressure plate 21 and the sheet feeding roller 28 is interrupted, so that the pressure plate 21 is moved forward and backward relative to the sheet feeding roller 28 independently of driving of the sheet feeding roller 28, using a solenoid 920 or the like, as shown in FIG. 9.

In this case, the solenoid 920 is held by the main body portion of an automatic sheet feeding device. Further, driving means (not shown) drives and stops a plunger 920*a* so as to move it forward and backward relative to the pressure plate 21, thereby pressing and releasing, that is, vibrating the pressure plate 21.

With the above configuration, as shown in FIG. 2, if the back end of the print sheet P lies in the back end printed area (K), the sheet is transported (step 906), and the plunger 902*a* is then moved away from the pressure plate 21. Thus, the pressure plate 21 abuts against the sheet feeding roller 28 due to the pressing force of a pressure plate spring 212, and an impact occurring upon the abutment causes vibration. In this case, the sheet feeding roller 28 is not rotated, so that the sheet feeding operation is not performed even if any print sheets P remain on the pressure plate 21.

If this vibration may shift the transportation roller 36 to its stabilized position, image corrections or the like are executed.

The other parts of the configuration and operation of this embodiment are similar to those of the first embodiment.

<Third Embodiment>

Now, a third embodiment of the present invention will be described. In the above embodiments, the transporting means is vibrated by reciprocating the carriage 50 or moving the pressure plate 21 in the vertical direction, but in the third embodiment of the present invention, the pinch roller holder 30 is vibrated as shown in FIG. 10.

Figure 10:
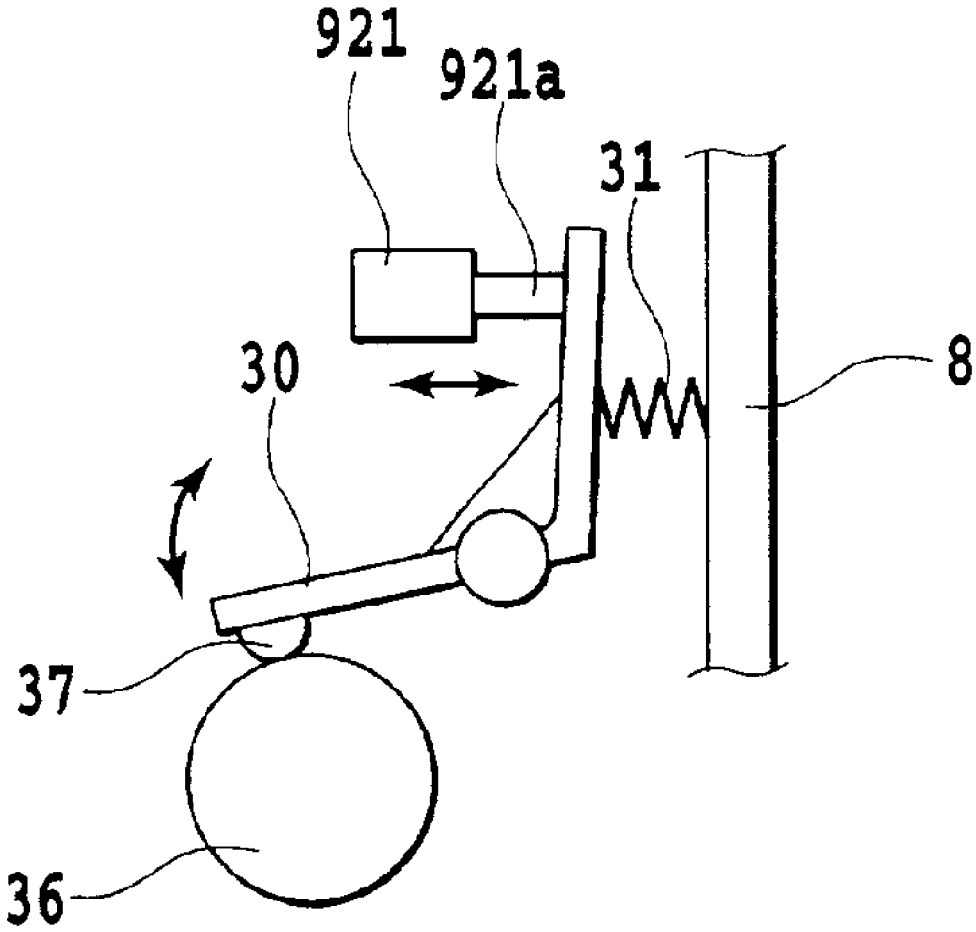
FIG. 10 is a side view useful in describing vibrating means according to a third embodiment of the present invention.
Figure 11:
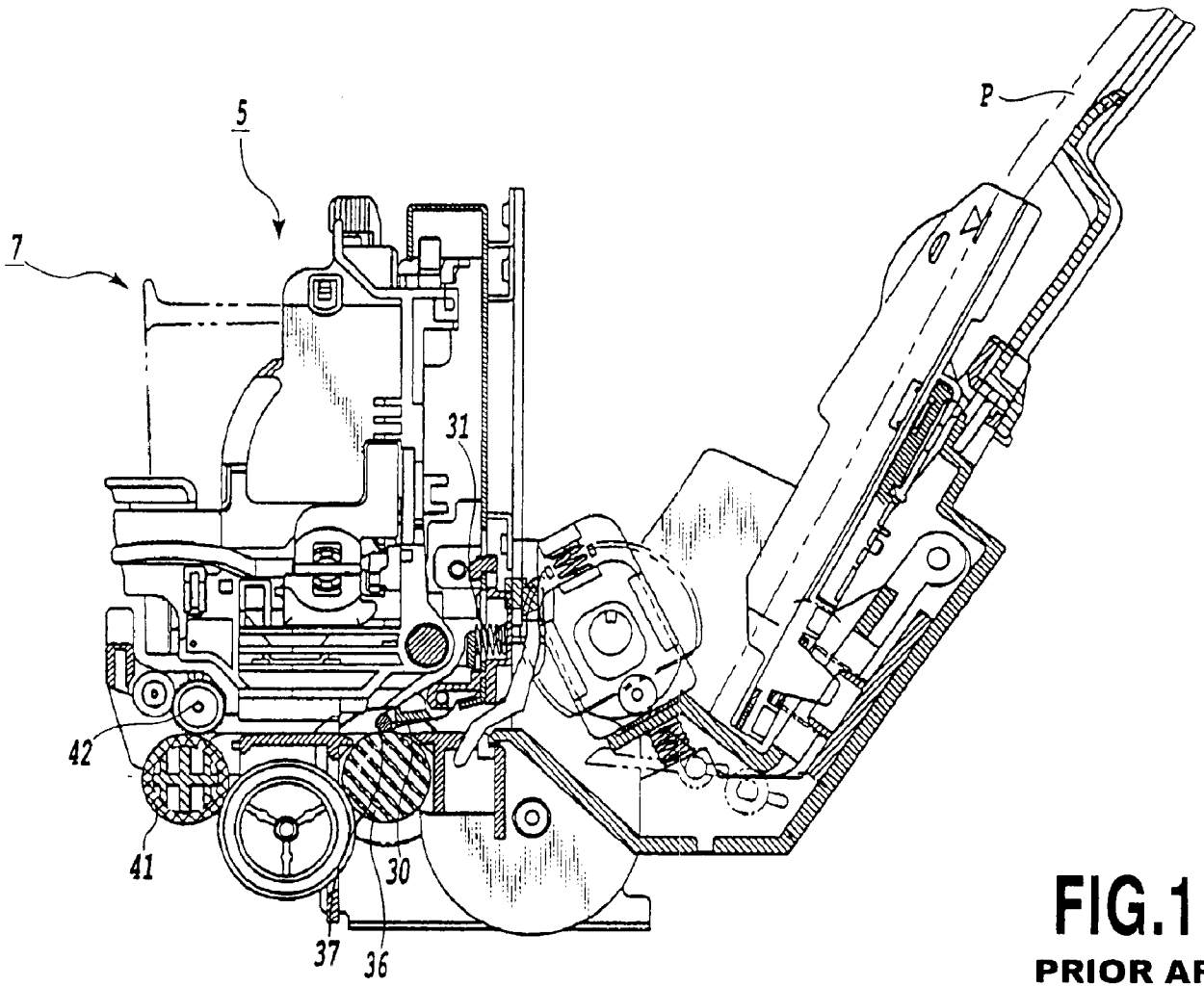
FIG.11 PRIOR ART
FIG. 11 is a transverse sectional view showing a printing apparatus according to a conventional example.
Figure 12A:
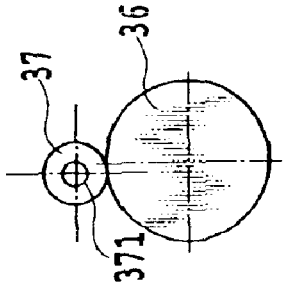
FIG.12A PRIOR ART
FIGS. 12A and 12B are views showing the relationship between a transportation roller and a pinch roller in the conventional printing apparatus.
Figure 12B:
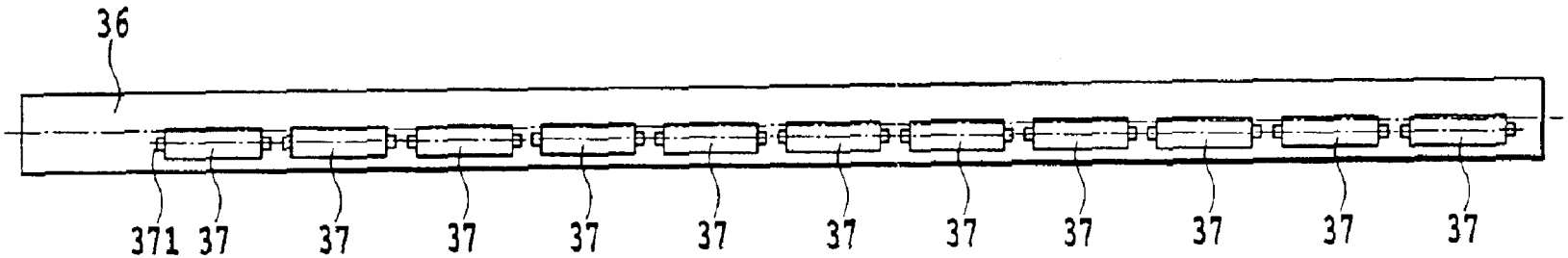
FIG.12B PRIOR ART

That is, FIG. 10 shows the third embodiment, wherein the pinch roller holder 30, having the pinch roller 37 rotatably supported at one end thereof, has its central portion rotatably supported on the chassis 8. Further, the chassis 8 also holds a solenoid 921 having a plunger 921*a* located opposite the other end of the pinch roller holder 30. The pinch roller holder 30 is urged by the spring 31 so that the other end thereof abuts against the plunger 921*a*. The solenoid 921 is held by the chassis 8 so that the plunger 921*a* is located opposite the other end of the pinch roller holder 30.

With the above configuration, if the back end of the print sheet P lies in the back end printed area (K), the pinch roller holder 30 is vibrated by moving the plunger 921*a* forward and backward after the print sheet has been transported. Then, vibration is transmitted from the pinch roller holder 30 to the pinch roller 37 and the transportation roller 36, which thus rotates to its stabilized position if it has been in an unstable state. Thus, image corrections can be executed if the position of the transportation roller 36 is deviate.

The other parts of the configuration and operation of this embodiment are similar to those in the first embodiment.

In the above embodiments, the members and driving sources already installed in the printing apparatus are utilized to constitute all or part of the vibrating means, thereby simplifying the configuration and reducing costs.

However, the present invention is not limited to the above embodiments, but a self-vibrating device that is perfectly independent of the printing apparatus may be additionally provided without using any of the existing members of the printing apparatus.

Further, in the above embodiments, the transporting means for transporting a print medium has been illustrated as the transportation roller and pinch roller which transport the print medium by sandwiching it therebetween. The present invention is not limited to the transporting means that transports the print medium by sandwiching it therebetween, but is effectively applicable to other transporting means having other configurations. For example, the present invention is applicable to, for example, a printing apparatus in which continuous paper having punches formed at the opposite ends thereof is transported by a sprocket (movable member) that engages with the punches.

The above embodiments have been described in conjunction with the print heads based on the ink jet method, notably what is called the BJ method, but the present invention is applicable without depending on these printing methods for the print heads, as is apparent from the description of the embodiments. As a printing method for the print heads, for example, a piezo method may be used instead of the BJ method. Alternatively, print heads may be used which are based on a thermal transfer method or the like instead of the ink jet method and which thus have print elements arranged therein.

As described above, according to the present invention, the transporting means is vibrated before the printing means performs a printing operation on a print medium. Thus, if the transporting member of the transporting means is in an unstable state, image correcting and printing operations can be performed after the transporting means has been moved to its stabilized position. This configuration also prevents the disturbance of the image, that is, oblique printing caused by inappropriate transportation of the print sheet during a printing operation.

Further, the present invention requires no brake or the like, which increases load torque required for the transporting means, thereby eliminating the need to use a higher-grade driving source and allowing the apparatus to be inexpensively constructed.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus including transporting means for transporting a print medium relative to printing means for printing an image on a print medium, the apparatus comprising:

a carriage for supporting said printing means and reciprocating said printing means in a direction crossing a direction in which the print medium is transported; and control means for controlling said printing apparatus so that said printing apparatus performs a transportation by said transporting means and printing by said printing means in sequence, and so that said carriage moves to vibrate said transporting means without performing a printing after said transporting means completes a transportation and before said printing means starts a printing.

2. A printing apparatus according to claim 1, wherein said transporting means comprises a movable member installed so as to move or stop relative to a travel path for the print medium, and said movable member contracts, while moving, with the print medium in said travel path to transfer the print medium, and is held, while stopped, at a predetermined stabilized position normally.

3. A printing apparatus according to claim 1, wherein said transporting means comprises a pair of rollers installed in the travel path for the print medium and opposite each other, roller urging means for urging said pair of rollers so that the rollers sandwich the print medium therebetween, and driving means for rotationally driving at least one of said pair of rollers.

4. A printing apparatus according to claim 3, wherein said pair of rollers comprises a transportation roller located upstream of the printing means in a transporting direction thereof and driven by a predetermined driving means, and a pinch roller that rotates in connection with the transportation roller.

5. A printing apparatus according to claim 4, further comprising a pinch roller holder that rotatably supports said pinch roller.

6. A printing apparatus according to claim 4, wherein said carriage moves to vibrate said transporting means after at least a back end of the print medium has passed through an abutted portion between said transportation roller and said pinch roller.

7. A printing apparatus according to claim 4, further comprising detection means for detecting a position at which said transportation roller is stopped, and if it is detected that said transportation roller stopped position is deviate from a desired one after said carriage has moved to vibrate the transporting means, then said transportation roller stopped position is corrected before a print head performs a printing operation.

8. A printing apparatus according to claims 7, wherein said detection means comprises a signal generator that generates pulse signals the number of which corresponds to rotation of said transportation roller, and counting means for counting the number of signals from the signal generator.

9. A printing apparatus according to claim 4, further comprising detection means for detecting a position at which said transportation roller is stopped, and if it is detected that said transportation roller stopped position is deviate from a desired on after said carriage has moved to vibrate the transporting means, then printing is carried out by shifting an operative portion of the printing means in the transporting direction depending on the amount of the positional deviate.

10. A printing apparatus according to claim 9, wherein said detection means comprises a signal generator that generates pulse signals the number of which corresponds to rotation of said transportation roller, and counting means for counting the number of signals from the signal generator.

11. A printing apparatus according to claim 1, wherein said carriage moves to vibrate the transporting means by performing at least one reciprocation.

12. A printing apparatus according to claim 1, further comprising a pressure plate that supports the print medium, a sheet feeding roller that feeds print medium supported on said pressure plate, a spring for pressuring a print medium supported by said pressure plate onto said feeding roller, and releasing means for placing a space between said pressure plate and said sheet feeding roller.

13. A printing apparatus according to claim 12, wherein said pressure plate is movable in forward and backward direction relative to said sheet feeding roller, wherein the forward and backward movement is carried out in connection with a sheet feeding operation performed by said sheet feeding roller, and while said pressure releasing means is performing a pressing or releasing operation, the driving of said sheet feeding roller is interrupted.

14. A printing apparatus according to claim 1, wherein said printing means uses thermal energy to generate bubbles in ink so that energy generated by the bubbles causes the ink to be ejected.

* * * * *

UNITED STATES PATENT AND TRADEMARK OFFICE

CERTIFICATE OF CORRECTION

PATENT NO. : 6,939,064 B2
DATED : September 6, 2005
INVENTOR(S) : Koichiro Kawaguchi et al.

It is certified that error appears in the above-identified patent and that said Letters Patent is hereby corrected as shown below:

Title page,
Item [56], References Cited, FOREIGN PATENT DOCUMENTS,
"55067467" should read -- 55-67467 --.
Item [30], Foreign Application Priority Data,
"2001/024553" should read -- 2001-024553 --.

Column 2,
Line 5, "an printed" should read -- a printed --.
Line 56, "deviate" should read -- deviation --.

Column 4,
Line 4, "control" should read -- controls --.

Column 5,
Line 55, "comes" should read -- come --.

Column 6,
Line 13, "have" should read -- has --.
Line 15, "installed" should read -- which is installed --.
Line 52, "grow or contact" should read -- growth or contraction --.

Column 7,
Line 32, "is" should read -- are --.

Column 9,
Line 16, "deviate," should read -- deviation, --.

Column 10,
Line 14, "shown" should read -- as shown --.

Column 11,
Line 6, "the number" should read -- number --.
Line 8, "sift" should read -- shift --.
Line 24, "deviate" should read -- deviation --.

Column 13,
Line 38, "contracts," should read -- contacts, --.

UNITED STATES PATENT AND TRADEMARK OFFICE

CERTIFICATE OF CORRECTION

PATENT NO. : 6,939,064 B2
DATED : September 6, 2005
INVENTOR(S) : Koichiro Kawaguchi et al.

It is certified that error appears in the above-identified patent and that said Letters Patent is hereby corrected as shown below:

Column 14,
Line 24, “on” should read -- one --.
Line 27, “deviate.” should read -- deviation. --.
Line 45, “in” should read -- in a --.

Signed and Sealed this

Twenty-eighth Day of February, 2006

JON W. DUDAS
*Director of the United States Patent and Trademark Office*